United States Patent [19]

Van Santen

[11] 4,272,058

[45] Jun. 9, 1981

[54] SCREW AND NUT ARRANGEMENT FOR JACK POSTS

[75] Inventor: Gordon L. Van Santen, Woodstock, Canada

[73] Assignee: Pliotron Corporation of Canada Limited, Stoney Creek, Canada

[21] Appl. No.: 939,116

[22] Filed: Sep. 5, 1978

[30] Foreign Application Priority Data

Sep. 6, 1977 [GB] United Kingdom ..... 37204/77

[51] Int. Cl.[3] ..... B66F 3/08

[52] U.S. Cl. ..... 254/98; 411/427

[58] Field of Search ..... 254/98–103; 85/32 R, 34; 151/41.76, 68

[56] References Cited

U.S. PATENT DOCUMENTS

| | | | |
|---|---|---|---|
| 2,233,224 | 2/1941 | Quarnstrom | 85/34 |
| 2,387,799 | 10/1945 | Leland | 254/98 |
| 2,422,795 | 6/1947 | McKnight | 254/98 |
| 2,504,291 | 4/1950 | Alderfer | 254/98 |
| 2,876,990 | 3/1959 | Grabowski | 254/98 |
| 3,738,613 | 6/1973 | Hollis | 254/98 |

FOREIGN PATENT DOCUMENTS

| | | | |
|---|---|---|---|
| 721679 | 1/1955 | United Kingdom | 151/68 |

*Primary Examiner*—Robert C. Watson

*Attorney, Agent, or Firm*—Brumbaugh, Graves, Donohue & Raymond

[57] ABSTRACT

A screw for use in jack posts has a minor unthreaded portion and a major threaded portion, a spigot extends from the end of the threaded portion with flats on the spigot to permit application of a wrench for turning the screw and, a nut whose bottom surface is formed to engage on a jack post.

3 Claims, 3 Drawing Figures

SCREW AND NUT ARRANGEMENT FOR JACK POSTS

Figure 1:
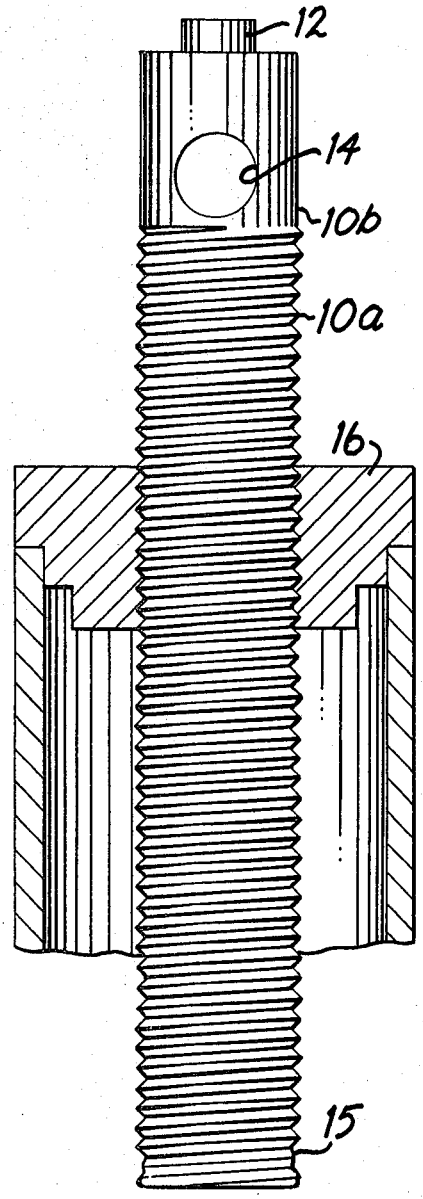
FIG. 1 (PRIOR ART)

The present invention relates so called jack posts, i.e. telescopic supporting posts used in buildings. In North American house building practice, such posts are commonly used to support joists at ground floor level above a concrete basement floor, but of course jack posts may be used in many other situations.

A typical conventional jack post is shown in U.S. Pat. No. 2,504,291 to Alderfer, issued Apr. 18, 1950. This comprises round telescoping tubes, including an outer base tube and an inner, upper tube, the upper tube having a transversely aligned pairs of bores which can receive a cross pin in different positions, the outer ends of the cross pin resting on top of the base tube to hold the two tubes in extended position. The top end of the upper tube carries a nut which receives an adjusting screw, the upper end of this screw terminating in a spigot which engages a top plate which bears against the item to be supported. The base of the lower tube rests on a similar plate.

The present invention is particularly concerned with screws and nuts for use in jack posts. The invention provides screws and nuts which represent a saving in material compared to conventionally used screws and nuts, which represent a saving in manufacturing expense, and which allow the screws and nuts to be packaged more conveniently.

In conventional jack posts, a screw is provided having a major threaded portion and a minor (top) unthreaded portion, a transverse bore in the unthreaded portion for receiving a bar for turning the screw, and a spigot extending from the unthreaded portion for engaging the top plate.

By contrast, a screw in accordance with the present invention comprises a minor unthreaded end portion, a major threaded portion, a spigot which extends from the end of the threaded portion which constitutes the top of the screw, and a pair of flats formed in the threaded portion to allow application of a wrench thereto. The advantages of this construction, as compared to the conventional construction, will appear from the further description referring to the drawings.

The present invention also provides a novel nut for use on the screw, or on a conventional screw. In accordance with one aspect of this invention, the nut has a flat annular bottom surface for locating on the end of a tube such as the inner tube of the jack post, and having a side surface which diverges outwardly from the top of the nut to the annular bottom surface, so that when the jack post is packaged the nut and screw combination, having been reversed end for end, can be located with the side surfaces extending partly within, and locating firmly, at the end of the outer tube.

In accordance with another aspect of the invention, the nut is formed by stamping this from sheet metal in such manner that the threaded length exceeds the metal thickness at the edges of the nut, and the nut has a substantially flat annular surface for engaging a tube end, on which surface protuberances are provided for engaging in the corners of a square jack post tube.

Figure 2:
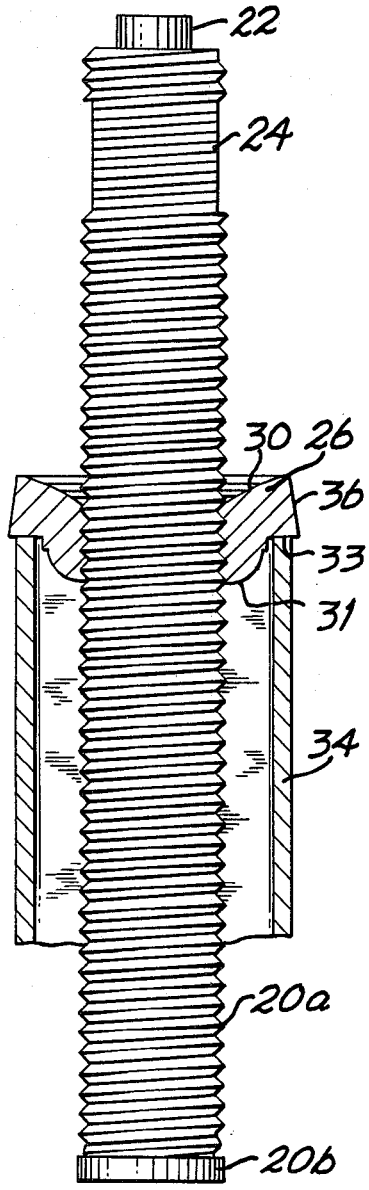
Figure 3:
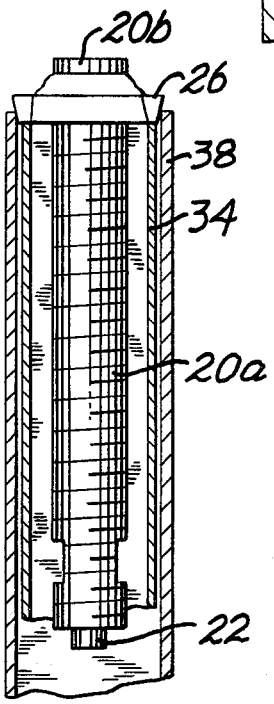

The invention will be more particularly described with reference to the accompanying drawings, in which:

FIG. 1 represents the prior art arrangement of screw and nut in association with the upper end of a jack post tube, FIG. 2 shows a similar view of the screw and nut of this invention, and FIG. 3 shows a view of outer and inner tubes of a jack post and the screw and nut, in the packaged condition.

Referring to the prior art arrangement of FIG. 1, the screw has a threaded, major lower portion 10*a*, a minor, unthreaded, upper portion 10*b*, and terminates in a top spigot 12. The unthreaded portion 10*b* is provided with a transverse bore 14 in to which a bar can be inserted for turning the screw. The lowest end portion 15 of the threads are damaged so that the screw cannot be entirely screwed out of the nut. This latter feature is required by building standards, since otherwise accidents could result from the screw being unscrewed too far from the nut.

In manufacture of this conventional screw, a piece of bar stock is first threaded, and the nut, such as nut 16, is then screwed onto the threads, after which the end portion 15 of the threads is damaged. This means that the screw cannot be made in a single operation.

The screw of this invention is shown in FIG. 2. This has a major threaded portion 20*a*, with an unthreaded lower end portion 10*b*. The unthreaded portion 20*b* provides the safety feature required since this cannot be unscrewed through the nut 26. The upper end of the threaded portion 20*a* is provided with flats 24, to which a wrench can be applied to turn the screw. The top of the screw ends in a spigot 22. The diameter of this screw is slightly smaller than that of the conventional screw, but the overall strength is the same since there is no weakening of this screw caused by the presence of the cross bore 14 of the conventional screw. Thus, this screw uses less material than the conventional screw. Also, the whole screw can be formed in one operation, and the nut 26 added later.

FIG. 1 also shows the conventional kind of nut 16, which is of cast iron. By contrast, the nut 26 of this invention, as shown in FIG. 2, is formed from a piece of sheet steel, by a stamping operation. This stamping operation is performed with a punch which indents the upper surface 30 of the nut, causing a protrusion 31 to be formed on the lower side of the nut, the stamping operation being performed in such manner that the thickness of the nut in the area of the screw thread is greater than the thickness at the edges, this latter thickness being the thickness of the original metal sheet. The nut is formed so as to have a flat annular bottom surface 33 at its outer periphery, this flat surface being suitable for engaging the upper end of the jack post tube 34. Preferably, this jack post tube is square in cross-section, and the surface 33 is provided with small downwards protuberances which engage in the corners of the square tube 34. The nut has side surfaces 36 which diverge outwardly from the top of the nut to the annular bottom surface, this slope being produced by the bending of the sheet metal which occurs during the stamping operation, but having a particular utility in the packaging of the screw and nut combination.

The end of the jack post when packaged is shown in FIG. 3. Further details concerning the packaging of this novel jack post are described in our co-pending patent application Ser. No. 939,115 filed concurrently herewith. In addition to the upper, inner tube 34, the package includes the lower, outer tube 38, which in the packaged condition extends just slightly beyond the end of the inner tube 34. For purposes of packaging, the screw and nut combination is removed from the tube 34, and the screw is rotated within the nut until the nut abuts the unthreaded end portion 20*b* of the screw. The screw is then placed within the tube 34, so that the screw and nut combination are reversed relative to the normal arrangement as shown in FIG. 2. The end of the nut which is normally the top then rests on the top of the tube 34, and the outer sloping side surfaces of the nut engage snugly within the end of the outer tube 38. This packaging arrangement provides a neat blunt end to the package, less likely to tear a package than the normally projecting spigot end of the conventional arrangement.

The screw and nut combination of this invention costs less in material both for the screw and the nut, and in labor of manufacture. The packaging is cheaper and easier, and the appearance is better. Also, the design is safer in that, if overloaded, the sheet steel nut will merely bend gradually, rather than breaking suddenly as with a cast iron nut.

What we intend to claim is:

1. In a jack post, the improvement comprising a screw having a minor unthreaded end portion and a major threaded portion, a spigot extending from the end of the threaded portion and a pair of flats formed in the threaded portion to allow application of a wrench for turning the screw, the unthreaded end portion being adapted to prevent movement therepast of a nut received in threaded engagement on the threaded portion during extension of the jack post, and said screw being free of any transverse bore therethrough, said nut being of stamped sheet metal and being such that the threaded length exceeds the metal thickness at the edges of the nut, said nut having a substantially flat annular tube engaging surface on which is provided protuberances for engaging in the corners of a square tube, said nut having a protrusion surrounding the threads thereof, said protrusion being surrounded by said flat annular surface, and said nut having side surfaces which converge away from said flat annular surface towards the end of the nut remote from said protrusion, said nut being dimensioned so that said side surfaces engage the interior of an end of an outer tube with the nut received partially within the tube in a collapsed, packaged condition of the jack post.

2. A jack post comprising inner and outer tubes adapted to be fitted together in telescoping relationship, and a screw and nut combination in which the nut has in an operative position a flat annular bottom surface located on the end of the inner tube, and having a side surface which diverges outwardly from the top of the nut to said annular bottom surface, said nut being dimensioned such that when the jack post is packaged, the side surface can locate within the end of said outer tube in wedging engagement with the end of the tube to hold the nut and screw in place.

3. A jack post having an operative condition and a packaged condition, inner and outer tubes adapted to be fitted together in telescoping relation, a stamped metal nut adapted to seat on the end of the inner tube when the jack post is in operative condition, a screw having a major threaded portion extending in threaded relation through said nut, a spigot at the uppermost end of the screw in said operative condition, a minor unthreaded portion of said screw remote from said spigot and adapted to prevent removal of the nut from the lower end of the screw with the jack post in said operative condition, said screw being free of any transverse opening therethrough, flats formed on the screw proximate the spigot to permit turning of the screw to adjust the length of the jack post, and said nut having diverging side surfaces adapted to fit partially into the outer tube in engagement therewith when said jack post is in its packaged condition.

* * * * *